US006945187B1

(12) United States Patent
Woodall et al.

(10) Patent No.: US 6,945,187 B1
(45) Date of Patent: Sep. 20, 2005

(54) INSTRIDE INFLATABLE AUTONOMOUS FUEL DEPOT

(75) Inventors: Robert Woodall, Panama City Beach, FL (US); Felipe Garcia, Panama City, FL (US); Chris Doyle, Panama City Beach, FL (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 10/803,136

(22) Filed: Mar. 15, 2004

(51) Int. Cl.[7] ..... B65D 88/78
(52) U.S. Cl. ..... 114/256; 114/244; 114/321
(58) Field of Search ..... 114/242, 253, 256, 114/312, 321, 330, 333, 244

(56) References Cited

U.S. PATENT DOCUMENTS 3,698,339 A * 10/1972 Golay et al. ..... 114/321
3,779,196 A * 12/1973 Knaus et al. ..... 114/256
4,506,623 A * 3/1985 Roper et al. ..... 114/256
5,235,928 A * 8/1993 Shank, Jr. ..... 114/244
6,550,410 B2 * 4/2003 Reimers ..... 114/256

* cited by examiner

*Primary Examiner*—Lars A. Olson
(74) *Attorney, Agent, or Firm*—James T. Shepherd

(57) ABSTRACT

A fuel depot and method autonomously and clandestinely provide fuel for transiting ships. An elongate streamlined flexible bladder member has flexible hull walls and divider walls separated by uniform spaces to form fuel compartments having a fuel valve and fuel pump. The bladder member can transit submerged to a remote destination. A fuel and water tight composition in and along the spaces prevent fuel and water leaks to ambient water and between the compartments. A submersible propulsion system has propulsive machinery and steering gear for towing the bladder member. A command/control system on the submersible propulsion system generated and couples driving signals to the propulsion system to tow and steer the bladder member to the remote destination using the preprogrammed computer, inertial navigation system (INS), global positioning system (GPS), and RF transceiver of the command/control system.

20 Claims, 2 Drawing Sheets

18
16
48
78
78A
34
54
40, 17
38
32
42, 44, 46, 50, 62
36
5
60
24
20

18
34
32
12
60
44, 50, 62
58
17
18A
55C
57
55
55B
56
54
36, 40
55A
52

18
32
24
20

INSTRIDE INFLATABLE AUTONOMOUS FUEL DEPOT

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

This invention relates to a system using a lightweight expandable fuel container. More particularly, this invention relates to a cost effective fuel-replenishing system having expandable, inflatable bladders filled with petroleum products that are capable of being towed through water to remote places to supply fuel where needed.

Most modern navies are responsible for transporting personnel and their equipment over extended supply lines to distant objectives ashore. Because of the distances involved, refueling of ships and other craft often is required during transit.

One well known method to assure sufficient refueling capability is to deploy one or more ships as dedicated tanker ships at designated re-fueling depots along the transit route to facilitate ship-to-ship refueling. Troop and supply laden ships and other craft in need of refueling pull alongside or behind each tanker ship at the refueling depots. The tanker ship and ships and craft then are anchored together with tethers and large floating bumpers, and fuel lines are passed from one craft to the other. Careful maneuvering on the part of all craft is necessary to keep the operation safe such that fuel lines and tethers do not break or that metal hulled craft do not bang into one another causing structural damage.

Aside from the fact that this refueling scenario is intensive to coordinate, is time consuming, and may be tactically dangerous, the ships and personnel that are dedicated to carrying the fuel supply can be dispersed to different depots for undue periods of time. As a consequence, they cannot be available to support other logistics missions that they were originally designed to perform. Another problem is that some of the craft being used as refueling tankers typically are not designed for such missions and have to be modified or fitted with kits to perform the function of being a tanker/fuel depot. A further limitation of this scenario is that the tanker craft usually are expensive and irreplaceable assets that should not be put in harms way susceptible to enemy fire while acting simply as an at-sea fuel tank.

Thus, in accordance with this inventive concept, a need has been recognized in the state of the art for an inexpensive, relatively disposable system and a method of covertly or clandestinely pre-positioning fuel that provides an autonomous refueling depot at the exact location it is needed to support advancing expeditionary forces, to free up other navy craft for other high value missions that they were originally designed to support.

OBJECTS AND SUMMARY OF THE INVENTION

An object of the invention is to provide a system and method for supplying fuel to ships and other craft advancing across the open ocean.

Another object of the invention is to provide system and method for refueling ocean going craft that can provide fuel at the exact location it is needed.

Another object of the invention is to provide a portable system and method for refueling ocean going craft that frees-up other navy craft for other high value missions that they were designed to support.

Another object of the invention is to provide a system and method for refueling having a lightweight, compact, expandable fuel container.

Another object of the invention is to provide system and method for refueling having a low cost expandable container to be filled with fuel and/or deployed from inside or outside amphibious well-deck ships.

Another object of the invention is to provide a system and method for refueling having an expandable container and capability to autonomously pilot the fuel tank to a desired mid-transit location and an interrogation means to identify its location to intended users.

Another object of the invention is to provide a system and method for refueling having a buoyancy control system to properly orient the fuel tank and adjust buoyancy as fuel is being pumped in/out, a means to pump fuel to users, and a means to stay on-station at a mid-transit location via anchor or pilot-less autonomous control system.

Another object of the invention is to provide a system and method for refueling having a means to seal each flexible fuel container from possible punctures and tears and to provide a level of self-repair ballistic resistance to projectiles and fragmentation hazards.

These and other objects of the invention will become more readily apparent from the ensuing specification when taken in conjunction with the appended claims.

Accordingly, the present invention is to a fuel depot and method for autonomously and clandestinely providing fuel to transiting ships. An elongate streamlined flexible bladder member has flexible hull walls and divider walls separated by uniform spaces to form fuel compartments having a fuel valve and fuel pump. The bladder member can transit submerged to a remote destination. A fuel and water tight composition in and/or along the spaces prevent fuel and water leaks to ambient water and between the compartments. A submersible propulsion system has propulsive machinery and steering gear for towing the bladder member. A command/control system on the submersible propulsion system generates and couples driving signals for the propulsion system to tow and steer the bladder member to the remote destination using the preprogrammed computer, inertial navigation system (INS), global positioning system (GPS), and RF transceiver of the command/control system.

DESCRIPTION OF THE PREFERRED EMBODIMENTS

Figure 1:
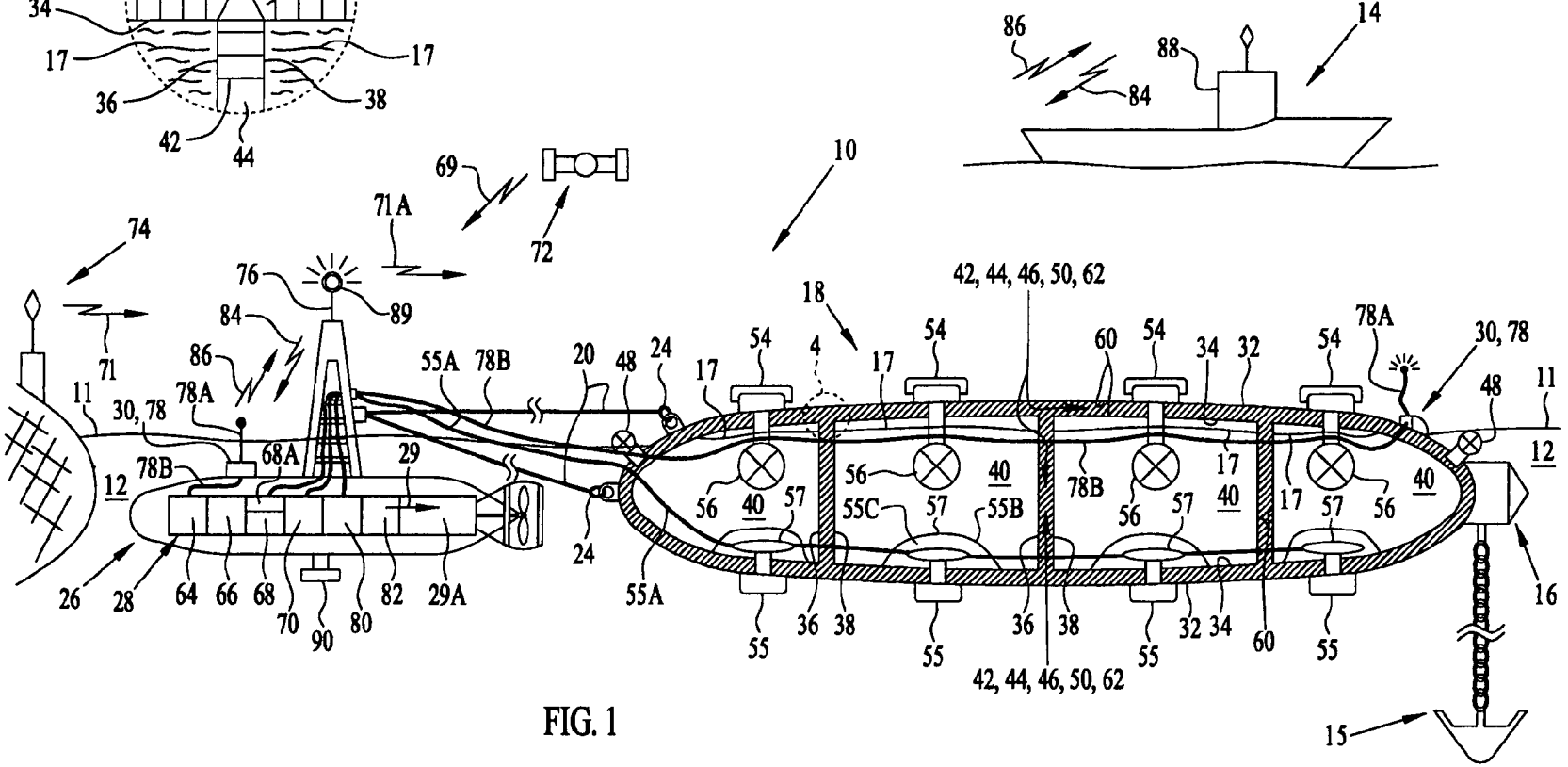
FIG. 1 is a schematic side view, shown partially in cross section, of the autonomous fuel depot of the invention in transit to or at a predetermined location for supplying fuel to ships and craft.
Figure 2:
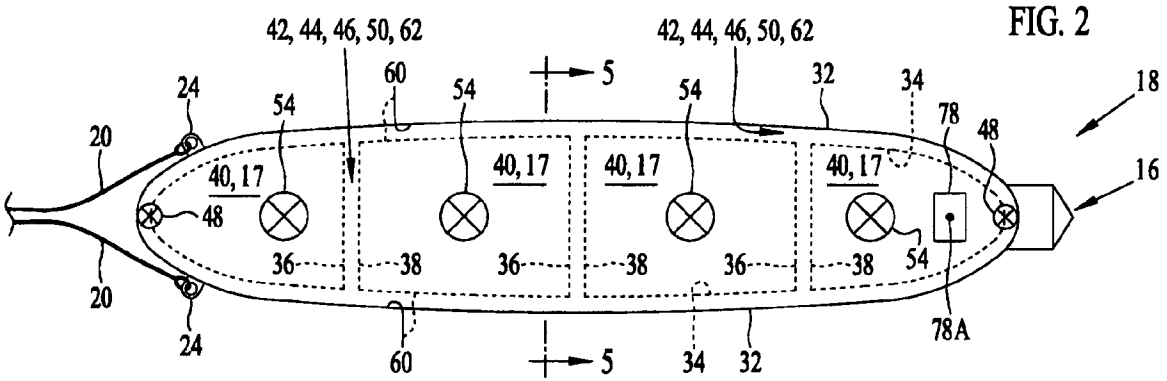
FIG. 2 is a schematic top view of the fuel depot showing details of an inflatable bladder member.

Referring to FIGS. 1 and 2, an inflatable, autonomous fuel depot 10 of the invention is depicted at the surface 11 of a body of water 12 such as the ocean. Fuel depot 10 can be deployed in an in-stride mode to replenish ships and other ocean-going craft 14 proceeding underway during transit between staging areas and distant objectives, or fuel depot 10 can be anchored as a fixed station moored along or near the transit-way by at least one anchor 15 dropped from an anchor bay 16. This flexibility allows fuel depot 10 to supply liquid fuel 17 and/or other fluids where needed to support successful passage.

In-stride autonomous fuel depot 10 has a flexible, bag-like, inflatable bladder member 18 for holding thousands of gallons of fuel 17. Because bladder member 18 flexible, it takes up little space when it is deflated. Consequently, prior to deployment several bladder members 18 can be stowed flat or rolled-up on deck, in holds, or in warehouses and not take up large amounts of space, see also FIG. 3. Bladder member 18 is connected to towing lines 20 via pad eyes 24 and has a streamlined, elongate shape pointed fore and aft to reduce hydrodynamic drag as it is towed through water 12. When inflated (fuel-filled) or deflated (empty), bladder member 18 can be made to have buoyancy in water 12 that permits submerged transit to allow clandestine deployment. Inflatable bladder member 18 of fuel depot 10 can be towed to a predetermined location by a propulsion system 26 connected to towing lines 20. A combination radio-controlled/autonomous command/control system 28 in propulsion system 26 assures controllable steering of fuel depot 10 to a selected location. At or on the way to the designated location, an interrogation system 30 on fuel depot 10 can transmit signals to reveal its location to users to expedite in-site refueling.

Inflatable bladder member 18 can have an outer flexible hull wall 32 and an inner flexible hull wall 34 and flexible divider walls 36 and 38 that extend across bladder member 18 and divide it into separate fuel compartments 40. Each of compartments 40 can be filled with the same type or a different composition of fuel 17 as desired.

Figure 4:
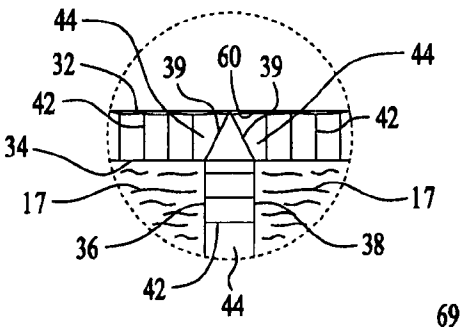
FIG. 4 is an enlarged view of some details of area 4 of FIG. 1.

Referring also to FIG. 4, walls 32, 34, 36 and 38 can be made of one or more layers of strong and flexible natural or man-made material and/or fabric, such as for example, the high tensile strength, flexible, and abrasion resistant material marketed under the trademark KEVLAR by DuPont Inc, 1007 Market Street, Wilmington, Del. 19898. A multitude of spaced-apart threads or flexible links 42 have their opposite ends connected to hull walls 32 and 34 and divider walls 36 and 38 to create spaces 44 between them. Spaces 44 virtually uniformly separate outer and inner hull walls 32 and 34 and divider walls 36 and 38 when pressurized gas or other pressurized fluid 46 is fed by one or more valves 48 into spaces 44. This distends spaces 44 and allows compartments 40 to extend to their flexible limits. Flexible walls 32, 34, 36, and 38 having threads/links 42 can be assembled to create joined-together spaces 44 forming a common spatial separation 50 among walls. Optionally, flexible walls 32, 43, 36, and 38 can be made to have flexible end divider portions 39 to isolate spaces 44 that are separated from one another.

Pressurized gas 46 in spaces 44 helps shape bladder member 18 into a streamlined, elongate form having oppositely tapered ends that reduce hydrodynamic drag as bladder member 18 is towed through water 12. When filled with JP5 or other military fuel, bladder member 18 can become slightly positively buoyant as the specific gravity of fuels 17 such as diesel, JP4 or JP5 jet fuels is slightly less than that of seawater 12 (0.8 vice 1.03 for seawater 12). Gas valves 48 can vent gas 46 from spaces 44 of separation 50 to allow their complete deflation along with bladder member 18 when fuel 17 has been pumped from compartments 40 by pumps 56.

A fuel port/valve 54 at the top of each compartment 40 is connected to a fuel pump 56 immersed in fuel 17 inside each compartment 40. Fuel port/valves 54 and fuel pumps 56 receive fuel 17 while compartments 40 of bladder member 18 are being filled at a tanker ship, for example. Fuel port valves 54 and fuel pumps 56 also pass fuel 17 from compartments 40 when refueling ships and craft 14 via hoses and fittings connected to port/valves 54. Fuel port/valves 54 have openings for venting air from compartments 40 to allow complete filling of compartments 40 without any air spaces and complete deflation of compartments 40 when fuel 17 has been pumped from them by pumps 56.

Figure 5:
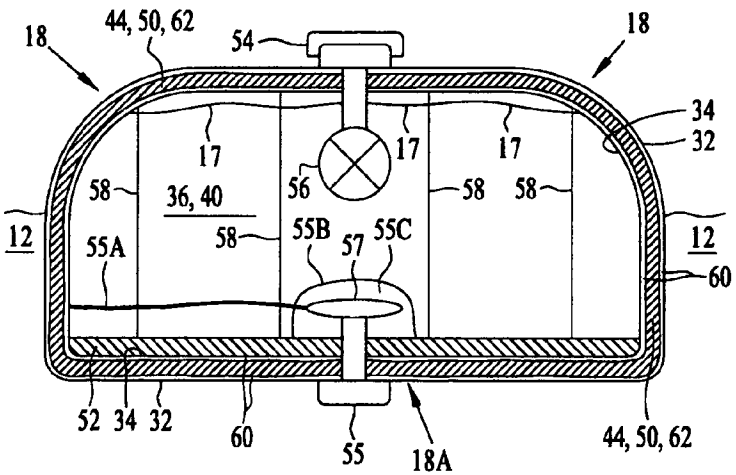
FIG. 5 is a cross-sectional view of an inflated or bladder member filled with fuel taken along line 5—5 in FIG. 2.

Referring also to FIG. 5, flexible hull walls 32 and 34, and flexible divider walls 36 and 38 are tailored to give bladder member 18 a cross-sectional shape having a flattened bottom 18A that helps hold each fuel port/valve 54 above each compartment 40 and above water 12. Several tensioner-straps 58 can be connected at opposite ends to the top and bottom parts of inner flexible wall 34 to extend across compartments 40 and help hold bottom 18A in its flattened shape. Negative ballast 52 also can be added at bottom 18A of compartments 40 to help maintain the upright orientation for water-free delivery of fuel 17 through fuel port/valves 54.

A ballasting valve 55 and small compressed air tank 57 can be located on bladder member 18 at the bottom of each compartment 40. Valves 55 and tanks 57 are connected by a control lead 55A to command/control system 28 to selectively control the buoyancy and ballast of bladder member 18. Positive buoyancy or negative ballasting of compartments 40 is done by venting some of ambient seawater 12 and/or pressurized air from tanks 57 in or out of compartments 40 by valves 55. The vented seawater can be blown out by pressurized air from tanks 57.

Since some ambient seawater 12 can be brought into compartments 40 to add ballast to them, bladder member 18 of fuel depot 10 can sink or submerge to a level that is at and below surface 11 of water 12 and be virtually visibly undetectable when bladder member 18 is filled or deflated. This buoyancy/ballasting capability of valves 55 and air tanks 57 in compartments 30 gives fuel depot 10 a buoyancy control option that can make it more clandestine.

Because fuel 17 is lighter than seawater 12, mixing of the liquids can be minimal when compartments 40 are at least partially filled with fuel 17. However, a flexible septum 55B can be included in each compartment 40 that extends over each valve 55 and air tank 57 to form a flexible ballasting chamber 55C that keeps fuel 17 and vented seawater separated when fuel 17 is contained in compartments 40, see FIGS. 1 and 5. Visible detection of the appropriately ballasted and buoyant bladder member 18, submerged propulsion system 26, command/control system 28 and interrogation system 30 is therefore virtually not possible from any appreciable distance. Upward protruding antennas to be described can be of such small dimensions as to be unnoticeable.

The clandestine, submerged condition of bladder member 18 can be reversed by venting air from tanks 57 to push out vented seawater 12 from compartments 40 through valves 55. Fuel pumps 56 also can be actuated to draw-in ambient air through fuel valves 54 to raise bladder member 18 to and above surface 11. These actuations of tanks 57, valves 55, fuel pumps 56, and valves 54 can be initiated in accordance with preprogrammed instructions in computer 64, remote RF control signals 71, GPS coordinate signals and/or location sensing by INS 66, as discussed below.

Each bladder member 18 can be constructed from a plethora of other materials than mentioned above and by many different techniques currently commercially available. Irrespective of the chosen materials and techniques, bladder member 18 is made to be flexibly inflatable and capable of securely containing large volumes of fuel 17, particularly when more than one is connected in-line or side-by-side. For example, a proven method of sealed construction of flexible fabric walls is illustrated by the tensioned stitched fabric sealing method pioneered by Zodiac International. Such sealed fabric construction techniques are shown by way of example in U.S. Pat. No. 6,074,261 wherein an inflatable pneumatic enclosure has a constrained geometric shape comprising two main walls, held relative to each other in an inflated state by a multiplicity of flexible links interposed between the walls and having an inflation valve fixed in at least one of the walls for inflating the enclosure. A wide variety of fabrics can be chosen and then sealed using the construction and fabric sealing techniques pioneered by Zodiac Inflatable Surface Craft. Another method to construct bladder member 18 can utilize the technology relied upon to make the foldable fluid storage units and the ocean-towable bladders known as Sea Slugs produced by CANFLEX USA, Inc. P. O. Box 1014, 412 Thirtieth Street, Anacortes, Wash. 98221.

Hull walls 32 and 34 and divider walls 36 and 38 can be made fuel and water-tight by impregnating or coating them with polymer, elastomer, or other compositions 60 that remain flexible after curing and are not soluble by either water 17 or fuel 17. Separating spaces 44 also could be filled with a viscous polymeric sealing gel-like composition 62 that is also fuel and water-tight and not soluble in water 12 or fuel 17. Optionally, sealing gel 62 could be impregnated in or coated on the surfaces of hull walls 32 and 34 and divider walls 36 and 38 adjacent to separating spaces 44. When a coating of sealing gel 62 is selected, it can be along the lines as described in U.S. Pat. No. 4,501,035, and an appropriate polymeric sealing material can be layered on the fabric sandwich of bladder member 18 to automatically seal punctures that might occur during use. An exemplary puncture sealing formulation that could be used can be found in U.S. Pat. No. 5,295,525. Compositions 60 and 62 can seal punctures in hull walls 32 and 34 and divider walls 34 and 36 to prevent fuel leaks to ambient water 12 and fuel and water leaks between or to compartments 40 like well known fuel tank sealants have sealed fuel tanks in military aircraft. Compositions 60 and gel 62 can assure protection of the environment and reduce the chances of catastrophic failure that could occur if the contents of one compartment 40 become mixed with the contents of another compartment 40.

Propulsion system 26 of autonomous fuel depot 10 can be any one of many different surface and submerged propulsion units to tow fuel-filled bladder member 18 to a designated remote location and return it empty for refilling at a resupply staging area. Propulsion system 26 could be a jet-ski type personal watercraft riding on surface 11, or a submersible torpedo-like unit like the U.S. Navy's current remote mine hunting system (RMS) vehicle that is schematically depicted in FIG. 1. Suitable steering gear and propulsive machinery well known in the art, as well as sufficient on-board fuel would be included in the selected design of propulsion system 26 to tow bladder member 18 to its intended destination. Propulsion system 26 can be made to have a relatively low, wide profile for stability and desirable stealth characteristics and is coupled to tow lines 20 extending to pad eyes 22 at the front of bladder member 18. The towing arrangement of propulsion system 26 and bladder member 18 has hydrodynamic efficiency when traveling through the water 12 to allow for greater ranges and higher speeds of transit when bladder member 18 is either inflated or uninflated.

A combination radio/autonomous command-control system 28 on propulsion system 26 of fuel depot 10 provides an autonomous deployment and recovery capability that enables fuel depot 10 to transit to predetermined locations or actively change its destination and location en route for refueling in light of changing tactical situations. Command/control system 28 can have a preprogrammed computer 64, an inertial navigation system (INS) 66, a global positioning system (GPS) 68 and/or RF transceiver 70 that individually or in combination can be used to generate driving signals (shown as arrow 29) for propulsion system 26 that steer fuel depot 10 to the location of an intended fueling rendezvous.

A wide variety of subsystems 29A of propulsion system 26 are responsive to signals such as driving signals 29 and have been around for years to effect responsive and desired changes in an interconnected system such as propulsion system 26. Typical subsystems 29A are off-the-shelf units used for radio-controlled model aircraft and ships and other radio-controlled devices. These subsystems 29A can be a part of propulsion system 26 and may include appropriate sets of servo-mechanisms and power supplies that can be connected to throttles and steering linkages of motor connected jet and/or propeller drives. The servo's can be controlled via interconnected logic circuits and/or software/firmware control that are linked to receive driving signals 29 that cause the servo's to displace the linkages to change speed and/or turn propulsion system 26 to the left or the right, and fuel depot 10 is steered onward.

A suitable design and appropriate programs and instructions for computer 64 of command/control system 28 to provide the necessary driving signals 29 for propulsion system 26 to power and maneuver fuel depot 10 are well known and can be readily be selected and tailored by one of ordinary skill in the art. An appropriate INS 66 of command/control system 28 can be selected from many known, available units and appropriately interfaced with propulsion system 26 by a routineer to create and couple the necessary driving signals 29 for propulsion system 26 for responsively steering fuel depot 10 to the intended fueling rendezvous. One skilled in the art would also select an appropriate off the shelf unit for GPS 68 of command/control system 28 that is responsive to GPS coordinate signals 69 from NAVSTAR satellites 72 to provide the necessary driving signals 29 that cause propulsion system 26 to take fuel depot 10 to intended destinations. RF transceiver 70 of command-control system 28 is responsive to RF control signals (shown as arrow 71) from a remote station 74. RF control signals 71 might be coupled from RF transceiver 70 to computer 64 to generate driving signals 29 that change course heading or speed and/or be used to stop progress, recall, or bring fuel depot 10 to an updated destination where it safe and/or needed.

A combination RF/GPS antenna 76 is mounted on propulsion system 26 to extend above surface 11 of water 12 and is connected to command-control system 28. RF/GPS antenna 76 receives impinging GPS coordinate signals 69 and RF control signals 71 and respectively connects them to GPS receiver 68A of GPS 68 and RF transceiver 70 to initiate responsive driving signals 29. Either of signals 69 or 71 can be coded to covertly control the progress of fuel depot 10 to a specific location or to initiate a real-time change as a situation changes.

Progression of fuel depot 10 to a fueling rendezvous can rely on driving signals 29 generated by GPS 68. Driving signals 29 are created in system 28 via appropriate power supply, logic control and servos that are linked to an impeller steerage unit 29A of propulsion system 26. Prior to deployment of fuel depot 10 destination GPS coordinates can be programmed into the logic unit of GPS 68 via keypad entry or later during transit via RF control signal 71. As fuel depot 10 proceeds forward, GPS 68 continually receives GPS location information signals 69 through antenna 76 from NAVSTAR Satellite System 74 and continually calculates its own position relative to the desired location. Responsive driving signals 29 control appropriate servos in propulsion system 26 to steer the fuel depot 10 either right or left in order to reach the desired rendezvous location. At any time during transit, RF control signals 71 can initiate generation of responsive driving signals 29 via RF transceiver 70 and command/control system 28 to updated information regarding an intended destination.

Interrogation system 30 has an identification friend or foe (IFF) unit 78 and antenna 78A that can be incorporated on propulsion system 26 (or on inflatable bladder member 18) and are connected to RF transceiver 70, a suitable IR transceiver 80 and/or a laser transceiver 82. IFF unit 78 is coupled to command/control system 28 via lead 78B and can be a responder responsive to receive or emit electromagnetic energy (shown as arrows 84 or 86 respectively) at radio frequency (RF), infrared (IR), or other shorter wavelengths like those commonly emitted by laser devices. Remote interrogating transceiver sources 88 on ships and craft 14 that are seeking the exact location of fuel depot 10 for refueling purposes, for example, can transmit coded interrogating energy 84 over a relatively wide area of the ocean region. When IFF unit 78 receives coded (or uncoded) interrogating energy 84 from ship 14 it can respond or reply by transmitting RF, IR, or laser emissions of coded electromagnetic energy 86 to reveal more precisely the location of fuel depot 10. Reciprocally, IFF unit 78 could send coded interrogating signals 86 from where fuel depot 10 is located along the transit route that indicate location, and the friendly ships 14 having remote sources 88 could home in on the location of the transmissions or translate the coded signals of energy 86 to find the otherwise hidden location of fuel depot 10. Both IFF unit 78 and distant interrogating sources 80 are appropriately tuned to be responsive to the RF, IR, and laser emissions and are well known in the art. Both IFF unit and remote source 88 can operate for periods of time in passive modes waiting to receive coded friendly electromagnetic signals 84 or 86. Optionally, a coded RF control signal (shown as arrow 71A) could be transmitted from RF transceiver 70 in a Chirp signal form to fuel depot 10 to cause it to respond and reveal its GPS location to ships 14 of friendly forces via signals 86. Another method would be to allow friendly forces of sources 88 to interrogate in the general area of a rendezvous point and have fuel depot 10 respond with a flashing strobe 89 on antenna 76. RF control signals 71, 71A for RF transceiver 70 can be very high frequency signals or higher and of limited transmitted power to limit the range of transmission to avoid unnecessary dissemination of the transmitted information. All transmitted signals including signals 84 and 86 also can be transmitted at controlled levels of power to avoid unwanted interception.

Another option of fuel depot system 10 is to include an acoustic transceiver 90 on propulsion system 26 (or bladder member 28). This capability can provide bidirectional acoustic communications links with distant acoustic stations using ambient seawater 12 as the transmitting path for information instead of radiating electromagnetic signals through the air as described above.

Figure 3:
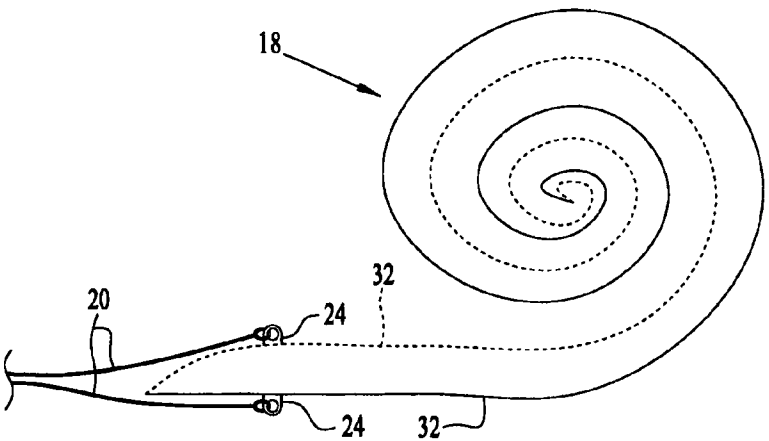
FIG. 3 is a schematic side view of a bladder member being in the deflated or unfilled condition during stowage and prior to deployment.

In operation, fuel depot 10 of the invention can be transported from a rear area into a theater of operations by conventional cargo ships and aircraft. Bladder member 18 is shipped and stored as a rolled or folded together package 90 to take up minimal space as shown in FIG. 3. Then, bladder member 18 is unfolded on a beach or in water 12 and connected to propulsion system 26 at a safe distance away from an area of possible conflict. Appropriate driving signals 29 generated by programming computer 64 in command/control system 28 on propulsion system 26 initiate propulsion system 26 to tow fuel depot 10 and autonomously progress to a tanker ship. Preprogramming and instructions entered in computer 64 along with GPS signals, INS inputs or RF signals received by command/communication system 28 cause propulsion system 26 to autonomously steer fuel depot to the side of a tanker ship or inside the well-deck of an amphibious ship. Compartments 40 of bladder member 18 are filled with fuel 17 and fuel depot 10 can autonomously proceed in accordance with predetermined instructions in command/control system 28 to a remote designated location. Preprogramming and instructions entered in computer 64 along with GPS signals, INS inputs, RF signals, and/or acoustic signals received by command/communication system 28 along the way can autonomously steer fuel depot 10 to the distant objective destination by propulsion system 26. Anytime along the way different destinations, different transit speeds, different times of arrival, etc. can be initiated from remote station 74 and ships 14, and ships 14 using their IFF units 88 can initiate IFF unit 78 to locate and establish precise rendezvous with fuel depot 10. When the supply of fuel 17 has been pumped from bladder member 18, command/control system 28 senses this and couples appropriate driving signals 29 to propulsion system 26 to tow the deflated bladder member 18 on a return trip to a tanker ship for replenishment or redeployment to a different destination. This procedure can be performed autonomously, but can be changed from a remote station 74 or ships 14.

Having the teachings of this invention in mind, modifications and alternate embodiments of system and method of fuel depot 10 can be made without departing from the scope of the invention. Its uncomplicated, compact design that incorporates structures long proven to operate successfully lends itself to numerous modifications to permit its reliable use under the hostile and demanding conditions encountered during some operations. System and method of fuel depot 10 can be fabricated in different physical arrangements from a wide variety of constituents that have proven capabilities to provide long term reliable deployment of needed POL products under a multitude of different operational conditions. System and method of fuel depot 10 of the invention can be modified within the scope of this inventive concept to provide reliable fuel replenishment for ships on their way to a theater of operations or could be used as a remote stationary fueling station that can return to a rear staging area for its replenishment.

The disclosed components and their arrangements as disclosed herein, all contribute to the novel features of this invention. System and method of fuel depot 10 provides an autonomous, reliable and capable means of assuring a supply of fuel 17 for ships and craft 14 in transit. Therefore, system and method of fuel depot 10, as disclosed herein are not to be construed as limiting, but rather, are intended to be demonstrative of this inventive concept.

It should be readily understood that many modifications and variations of the present invention are possible within the purview of the claimed invention. It is to be understood that within the scope of the appended claims the invention may be practiced otherwise than as specifically described.

We claim:

1. A fuel depot for autonomously and clandestinely providing fuel to ships and craft comprising:

an elongate streamlined flexible bladder member having flexible hull walls and divider walls forming compartments for containing fuel, said compartments each having a fuel valve and fuel pump, said hull walls and said divider walls being separated by uniform spaces, said bladder member having a controllable buoyancy permitting surface and submerged transit to a remote destination;

a fuel and water tight composition in communication with said hull walls and divider walls along said spaces for preventing fuel leaks to ambient water and fuel and water leaks between said compartments;

a submersible propulsion system connected by towing lines to said bladder member for towing said bladder member to said remote destination; and a command/control system on said submersible propulsion system for coupling driving signals to said propulsion system to tow and steer said flexible bladder member to said remote destination, said command/control system having a preprogrammed computer, an inertial navigation system (INS), a global positioning system (GPS), and RF transceiver to generate said driving signals.

2. The fuel depot of claim 1 further comprising:

spaced-apart flexible links having their opposite ends connected to said hull walls and divider walls to create said spaces; and pressurized gas fed to said spaces to distend and make them of uniform thickness.

3. The fuel depot of claim 2 further comprising:

negative ballast at the bottom of each compartment of said bladder member to help maintain upright orientation and assure reliable water-free delivery of said fuel through each fuel valve and fuel pump.

4. The fuel depot of claim 3 further comprising:

a ballasting valve and small compressed air tank at the bottom of each compartment for controlling buoyancy and ballasting of said bladder member, each ballasting valve selectively venting in some of said ambient water and each air tank selectively blowing vented water from each compartment with pressurized air.

5. The fuel depot of claim 4 wherein said selective venting and blowing provide provided said propulsion system and bladder member buoyancy control to submerge said bladder member to a level that is at and below the surface of said water and be visibly undetectable for clandestine transit to said remote destination.

6. The fuel depot of claim 5 further comprising:

a flexible septum in each compartment over each ballasting valve and air tank to form a flexible ballasting chamber in each compartment to separate fuel and vented water therein.

7. The fuel depot of claim 6 further comprising:

an identification friend foe IFF unit for receiving interrogating energy from a ship and responding the location of said fuel depot.

8. A method of autonomously and clandestinely providing fuel to ships and craft comprising the steps:

providing an elongate streamlined flexible bladder member having flexible hull walls and divider walls forming compartments for containing fuel, said compartments each having a fuel valve and fuel pump, said hull walls and said divider walls being separated by uniform spaces;

providing buoyancy control of said bladder member to permit submerged transit to a remote destination;

applying a fuel and water tight composition in communication with said hull walls and divider walls along said spaces;

preventing fuel leaks to ambient water and fuel and water leaks between said compartments by said composition;

connecting a submersible propulsion system by towing lines to said bladder member;

towing said bladder member submerged by said propulsion system to said remote destination;

coupling driving signals from a command/control system on said submersible propulsion system to said propulsion system, said command/control system having a preprogrammed computer, an inertial navigation system (INS), a global positioning system (GPS), and RF transceiver to generate said driving signals; and steering said flexible bladder member to said remote destination by said propulsion system receiving said driving signals from said command/control system.

9. The method of claim 8 further comprising the steps of:

connecting opposite ends of flexible links to said hull walls and divider walls to create spaces between said walls; and feeding pressurized gas fed to said spaces to distend and make them of uniform thickness.

10. The method of claim 9 further comprising the step of:

locating negative ballast at the bottom of each compartment of said bladder member to help maintain upright orientation and assure reliable water-free delivery of said fuel through each fuel valve and fuel pump.

11. The method of claim 10 further comprising the steps of:

selectively adding water ballast to said bladder member via a ballasting valve and small compressed air tank at the bottom of each compartment; and controlling buoyancy and ballasting of said bladder member by each ballasting valve selectively venting in some of said ambient water and each air tank selectively blowing vented water from each compartment with pressurized air from each air tank.

12. The method of claim 11 wherein said selective venting and blowing provide said propulsion system and bladder member buoyancy control to submerge said bladder member to a level that is at and below the surface of said water and be visibly undetectable for clandestine transit to said remote destination.

13. The method of claim 12 further comprising the step of:

separating water and fuel in each compartment by a flexible septum in each compartment over each ballasting valve and air tank to form a flexible ballasting chamber in each compartment.

14. The method of claim 13 further comprising the steps of:

incorporating an identification friend foe IFF unit on said bladder member;

receiving interrogating energy from an interrogating ship; and responding the location of said fuel depot to the interrogating ship.

15. A method of autonomously and clandestinely providing fuel to ships and craft comprising the steps:

providing an elongate streamlined flexible bladder member having flexible hull walls and divider walls forming compartments for containing fuel, said compartments each having a fuel valve and fuel pump, said hull walls and said divider walls being separated by uniform spaces;

providing buoyancy control of said bladder member to permit surface transit to a remote destination;

applying a fuel and water tight composition in communication with said hull walls and divider walls along said spaces;

preventing fuel leaks to ambient water and fuel and water leaks between said compartments by said composition;

connecting a surface propulsion system by towing lines to said bladder member;

towing said bladder member on the surface by said propulsion system to said remote destination;

coupling driving signals from a command/control system on said surface propulsion system to said propulsion system, said command/control system having a preprogrammed computer, an inertial navigation system (INS), a global positioning system (GPS), and RF transceiver to generate said driving signals; and steering said flexible bladder member to said remote destination by said propulsion system receiving said driving signals from said command/control system.

16. The method of claim 15 further comprising the steps of:

connecting opposite ends of flexible links to said hull walls and divider walls to create spaces between said walls; and feeding pressurized gas fed to said spaces to distend and make them of uniform thickness.

17. The method of claim 16 further comprising the step of:

locating negative ballast at the bottom of each compartment of said bladder member to help maintain upright orientation and assure reliable water-free delivery of said fuel through each fuel valve and fuel pump.

18. The method of claim 17 further comprising the steps of:

selectively adding water ballast to said bladder member via a ballasting valve and small compressed air tank at the bottom of each compartment; and controlling buoyancy and ballasting of said bladder member by each ballasting valve selectively venting in some of said ambient water and each air tank selectively blowing vented water from each compartment with pressurized air from each air tank.

19. The method of claim 18 wherein said selective venting and blowing provide said propulsion system and bladder member buoyancy control to submerge said bladder member to a level that is at and below the surface of said water and be visibly undetectable for clandestine transit to said remote destination.

20. The method of claim 19 further comprising the step of:

separating water and fuel in each compartment by a flexible septum in each compartment over each ballasting valve and air tank to form a flexible ballasting chamber in each compartment.

* * * * *